US012163262B1

(12) United States Patent
Zhu

(10) Patent No.: US 12,163,262 B1
(45) Date of Patent: Dec. 10, 2024

(54) BEADING APPARATUS

(71) Applicant: Fuxin International Trade Co., Limited, Kwun Tong (HK)

(72) Inventor: Shuijing Zhu, Changsha (CN)

(73) Assignee: Fuxin International Trade Co., Limited, Kwun Tong (HK)

( * ) Notice: Subject to any disclaimer, the term of this patent is extended or adjusted under 35 U.S.C. 154(b) by 0 days.

(21) Appl. No.: 18/581,782

(22) Filed: Feb. 20, 2024

(30) Foreign Application Priority Data

Dec. 29, 2023 (CN) ..... 202323667925.5

(51) Int. Cl.
*D04D 1/04* (2006.01)
*D04D 9/00* (2006.01)

(52) U.S. Cl.
CPC ..... *D04D 9/00* (2013.01); *D04D 1/04* (2013.01); *Y10T 29/53696* (2015.01)

(58) Field of Classification Search
CPC ..... D04D 1/04; D04D 9/00; Y10T 29/53696; B21L 11/12
USPC ..... 223/48; 29/241, 433
See application file for complete search history.

(56) References Cited

U.S. PATENT DOCUMENTS 2,641,389 A * 6/1953 Bagdon ..... D04D 1/04 223/48
2,670,109 A * 2/1954 Perry ..... D04D 1/04 223/48
3,791,007 A * 2/1974 Seleznev ..... G11C 5/12 29/737
4,280,266 A * 7/1981 Tomita ..... D04D 1/04 29/241

(Continued)

FOREIGN PATENT DOCUMENTS

JP H07229044 A * 8/1995
JP 2003213552 A * 7/2003

*Primary Examiner* — Nathan E Durham
(74) *Attorney, Agent, or Firm* — ScienBiziP, P.C.

(57) ABSTRACT

This application relates to the field of beading tools, and in particular to, a beading apparatus. The beading apparatus includes a bottom seat, a drive member, a rotation shell, and a needle-like assembly. The bottom seat has a placement surface for contact with an operation surface. The drive member is connected to the bottom seat. The rotation shell includes an accommodating body and a baffle, the accommodating body is connected to the drive member, the drive member drives the accommodating body to rotate, a rotation axis of the accommodating body is inclined with respect to the placement surface, the accommodating body is provided with an accommodating chamber for accommodating a bead-shaped structure, the accommodating chamber has an opening, and the baffle is connected in the accommodating chamber. The needle-like assembly is located on a side of the rotation shell, and at least part of the needle-like assembly extends into the accommodating chamber via the opening. The beading process is simple and quick, and the rotation axis of the rotation shell being inclined with respect to the placement surface can reduce the case of scattering the bead-shaped structure from the rotation shell. The baffle allows the bead-shaped structure to fly a greater distance, which is conducive to increasing the beading success rate, thus improving the beading effect.

18 Claims, 7 Drawing Sheets

(56) References Cited

U.S. PATENT DOCUMENTS 5,197,175 A * 3/1993 Yuen ..... D04D 1/04
29/241

* cited by examiner

BEADING APPARATUS

FIELD OF TECHNOLOGY

This application relates to the field of beading tools, and in particular to, a beading apparatus.

BACKGROUND

Beaded jewelry is a type of ornament formed by linking various bead-shaped structures such as beads, gemstones, or metal. It is always used for making accessories such as necklaces, bracelets, or earrings. The beading apparatus is a type of apparatus beading bead-shaped structures.

The use method of the beading apparatus in the prior art is typically as follows: Beads are placed on a rotation shell of the beading apparatus, and the rotation shell of the beading apparatus drives the bead-shaped structure to rotate, such that the bead-shaped structures can be beaded on the needle-like assembly of the beading apparatus. This type of beading apparatus, however, has a low beading success rate, and the bead-shaped structures are prone to scattering from the rotation shell, causing poor beading effect.

SUMMARY

An objective of this application is to provide a beading apparatus which can improve the beading effect.

To resolve the foregoing technical problem, the objective of this application is achieved with the following technical solution:

A beading apparatus is provided, including:

- a bottom seat, where the bottom seat has a placement surface for contact with an operation surface;
- a drive member, where the drive member is connected to the bottom seat;
- a rotation shell, where the rotation shell includes an accommodating body and a baffle, the accommodating body is connected to the drive member, the drive member drives the accommodating body to rotate, a rotation axis of the accommodating body is inclined with respect to the placement surface, the accommodating body is provided with an accommodating chamber for accommodating a bead-shaped structure, the accommodating chamber has an opening, and the baffle is connected in the accommodating chamber; and
- a needle-like assembly, where the needle-like assembly is located on a side of the rotation shell, and at least part of the needle-like assembly extends into the accommodating chamber via the opening.

In the beading apparatus in the foregoing embodiment, the bead-shaped structure is located in the accommodating chamber, the drive member drives the rotation shell to rotate, and the rotation shell drives the bead-shaped structure to rotate. When it rotates to a specified angle, the bead-shaped structure is thrown out by centrifugal force from the baffle and falls on the needle-like assembly. The beading process is simple and quick, and the rotation axis of the rotation shell being inclined with respect to the placement surface can reduce the case of scattering the bead-shaped structure from the rotation shell. The baffle allows the bead-shaped structure to fly a greater distance, which is conducive to increasing the beading success rate, thus improving the beading effect.

Further, the accommodating body includes a first portion and a second portion, one side of the first portion is connected to the drive member, the other side of the first portion fits with the second portion to form the accommodating chamber, and a side of the second portion away from the first portion is provided with the opening.

Further, the baffle includes a first blocking piece and a second blocking piece, the first blocking piece is connected to the first portion, the second blocking piece is connected to the second portion, and the first blocking piece is in one-to-one correspondence to the second blocking piece in position.

Further, such baffle is provided in plurality, and the plurality of baffles are spaced apart from each other around a rotation axis of the rotation shell.

Further, the baffle is parallel to the rotation axis of the rotation shell.

Further, the rotation axis of the rotation shell and the placement surface form a first included angle of 15°-45°.

Further, a side wall of the accommodating chamber away from the opening is provided with a guiding protrusion, and the part of the needle-like assembly extending into the accommodating chamber is located between the guiding protrusion and the baffle.

Further, an axis of the guiding protrusion overlaps the rotation axis of the rotation shell.

Further, the beading apparatus further includes a positioning assembly, the positioning assembly includes a positioning plate, a first positioning portion, and a second positioning portion, the first positioning portion and the second positioning portion are apart from each other on the positioning plate, the bottom seat is disposed at the positioning plate and fits with the first positioning portion for positioning, and the needle-like assembly is disposed at the positioning plate and fits with the second positioning portion for positioning.

Further, the first positioning portion is a first positioning protrusion, the bottom seat is provided with a first positioning groove, the first positioning protrusion is located in the first positioning groove, the second positioning portion is a second protrusion, the needle-like assembly is provided with a second positioning groove, and the second protrusion is located in the second positioning groove.

Further, the needle-like assembly includes a base and a beading needle, the base is located on a side of the bottom seat, and the beading needle has one end connected to the base and the other end extending into the accommodating chamber.

Further, the beading needle includes a needle tip, a needle body, and a needle eye that are connected sequentially, the needle tip is located in the accommodating chamber and faces a direction close to the needle body, the needle tip is inclined towards a plane on which the placement surface is located, the needle body has one end connected to the needle tip and the other end connected to the needle eye, and the needle body is connected to the base.

Further, the needle body includes a first segment, a second segment, and a third segment that are connected sequentially, the first segment is connected to an end of the needle tip and partially located in the accommodating chamber, and faces a direction close to the second segment, the first segment is inclined towards the plane on which the placement surface is located, the second segment is perpendicular to the plane on which the placement surface is located, the third segment is connected to the needle eye and parallel to the plane on which the placement surface is located, and the third segment is connected to the base.

Further, an included angle between the first segment and the plane on which the placement surface is located is smaller than an included angle between the rotation axis and the plane on which the placement surface is located.

Further, the base is provided with a snap-fitting structure, and the snap-fitting structure is snap-fitted with the beading needle.

Further, the snap-fitting structure includes two clamping blocks, and the two clamping blocks are apart from each other in a length direction of the beading needle and snap-fitted with the beading needle.

Further, the snap-fitting structure is a slot, and the slot is snap-fitted with the beading needle.

Further, the needle-like assembly further includes a counterweight block, the counterweight block is provided with a snap-fitting position for communication with the slot, and the beading needle is at least partially located at the snap-fitting position.

An embodiment of this application provides a beading apparatus including:

- a bottom seat, where the bottom seat has a placement surface and a mounting surface for contact with an operation surface, and the placement surface and the mounting surface intersect;
- a drive member, where the drive member is connected to the bottom seat;
- a rotation shell, where the rotation shell is connected to the drive member, the drive member drives the rotation shell to rotate, a rotation axis of the rotation shell and the placement surface form a first included angle, the rotation axis of the rotation shell and the mounting surface form a second included angle, the first included angle is different from the second included angle, the rotation shell is provided with an accommodating chamber for accommodating a bead-shaped structure, and the accommodating chamber has an opening; and
- a needle-like assembly, where the needle-like assembly is connected to the rotation shell, and at least part of the needle-like assembly extends into the accommodating chamber via the opening.

In the beading apparatus of the foregoing embodiment, the first included angle is different from the second included angle, and thus when the placement surface or the mounting surface is placed on the operation surface, the rotation axis and the operation surface form a different included angle. Thereby, based on the type of the bead-shaped structure in the accommodating chamber, a different surface can be selected to be in contact with the operation surface, thus improving the placement effect.

Further, the first included angle is 15°-45°, and the second included angle is 90°.

This embodiment of this application provides a beading apparatus. The rotation axis is inclined with respect to the placement surface and the arrangement of the baffle improves the flying distance of the bead-shaped structure, which is conducive to improving the beading success rate and reducing the case of scattering the bead-shaped structure from the opening, facilitating the improvement of the beading effect.

In another type of beading apparatus, as the bottom seat is provided with the placement surface and the mounting surface, a different surface can be selected to be in contact with the operation surface, thus adjusting the inclined angle between the rotation axis and the operation surface. And it is simple and quick to adjust the included angle between the rotation angle and the operation surface. Based on a different type of the bead-shaped structure, a different plane is selected to be in contact with the operation surface, which can improve the beading success rate and enjoyment.

BRIEF DESCRIPTION OF THE DRAWINGS

To describe the technical solutions in the embodiments of this application more clearly, the accompanying drawings required to describe the embodiments are briefly described below. Apparently, the accompanying drawings described below are only some embodiments of this application. A person of ordinary skill in the art may further obtain accompanying drawings of other embodiments based on these accompanying drawings without creative efforts.

Figure 1:
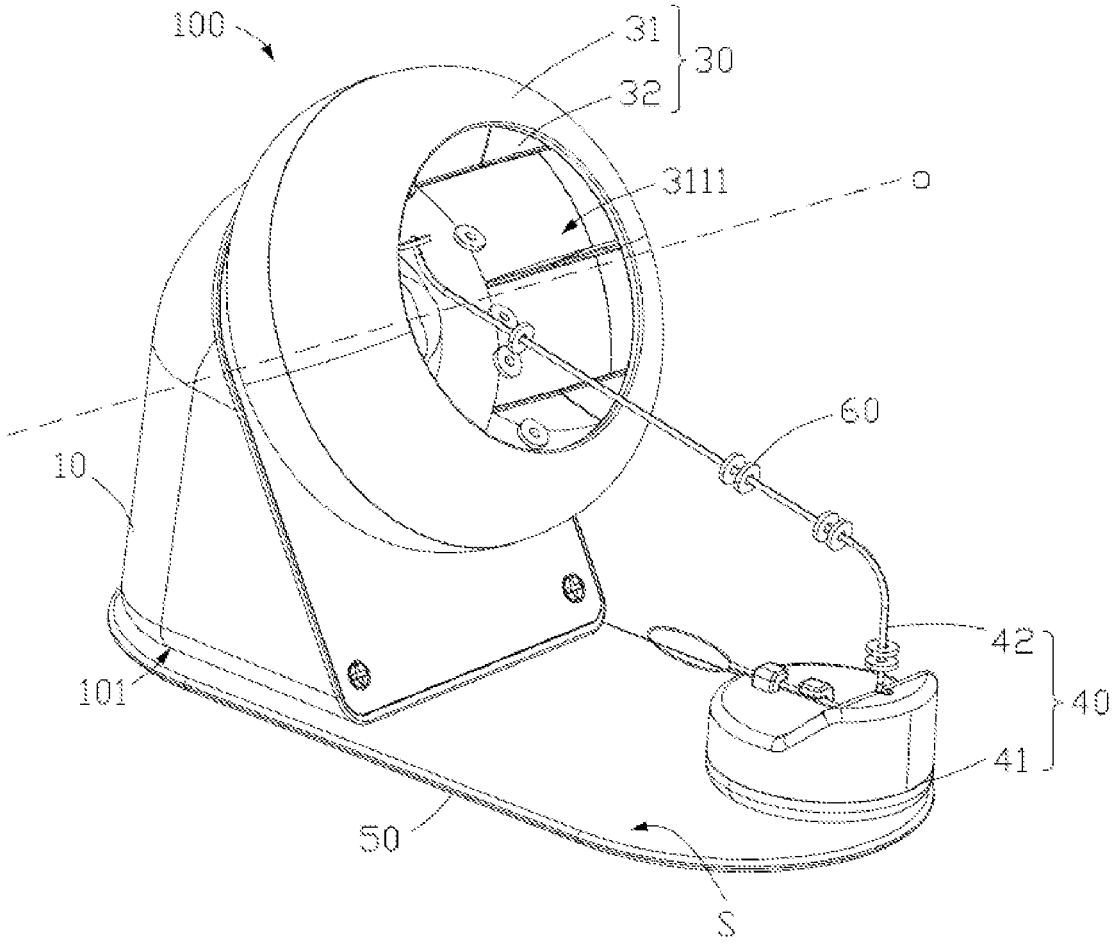
FIG. 1 is a three-dimensional structural diagram of a beading apparatus according to an embodiment of this application.

Numeral references: 100. beading apparatus;

10. bottom seat; 101. placement surface; 102. mounting surface; 103. inner cavity; 11. bottom shell; 111. first positioning groove; 12. upper cover; 13. front shell; 14. back shell; 15. first shell body; 16. second shell body; 17. third shell body;

20. drive member;

30. rotation shell, 31. accommodating body; 311. first portion; 312. second portion; 313. guiding protrusion; 3111. accommodating chamber; 3112. opening; 3113. connection hole; 32. baffle; 321. first blocking piece; 322. second blocking piece;

40. needle-like assembly; 41. base; 411. lower shell; 4111. limiting groove; 4112. second positioning groove; 412. upper shell; 42. beading needle; 421. first segment; 422. second segment; 423. third segment; 424. needle tip; 425. needle eye; 43. snap-fitting structure; 431. clamping block; 432. slot; 44. counterweight block; 441. snap-fitting position.

50. positioning assembly; 51. positioning plate; 52. first positioning portion; 52*a*. first positioning protrusion; 53. second positioning portion; 53*a*. second positioning protrusion;

60. bead-shaped structure;

S. operation surface; O. rotation axis; α. first included angle; and β. second included angle.

DESCRIPTION OF THE EMBODIMENTS

The technical solutions in embodiments of this application are described below clearly and completely with reference to the drawings in the embodiments of this application. Apparently, the described embodiments are merely some rather than all of the embodiments of this application. All other embodiments obtained by those of ordinary skill in the art based on the embodiments of this application without creative efforts should fall within the protection scope of this application.

It should be understood that when used in this specification and the accompanying claims, the terms "including" and "comprising" indicate the presence of the described features, entireties, steps, operations, elements, and/or assemblies, but do not exclude the presence or addition of one or more other features, entireties, steps, operations, elements, assemblies, and/or their combinations.

It should also be understood that the terms used in the specification of this application are solely for describing specific embodiments and not intended to limit this application. As used in the specification of this application and the accompanying claims, unless the context clearly indicates the other cases, the singular forms "one", "an", and "the" are intended to include the plural forms.

It should also be further understood that, in the specification of this application and the accompanying claims, the term "and/or" indicates any combination of one or more of items listed in conjunction, as well as all possible combinations, and includes these combinations.

It should be noted that in this embodiment, when "-" is used to indicate a range, endpoint values should be included. For example, in a range of 1-10, a value therein should be understood to be greater than or equal to 1 and less than or equal to 10.

Figure 2:
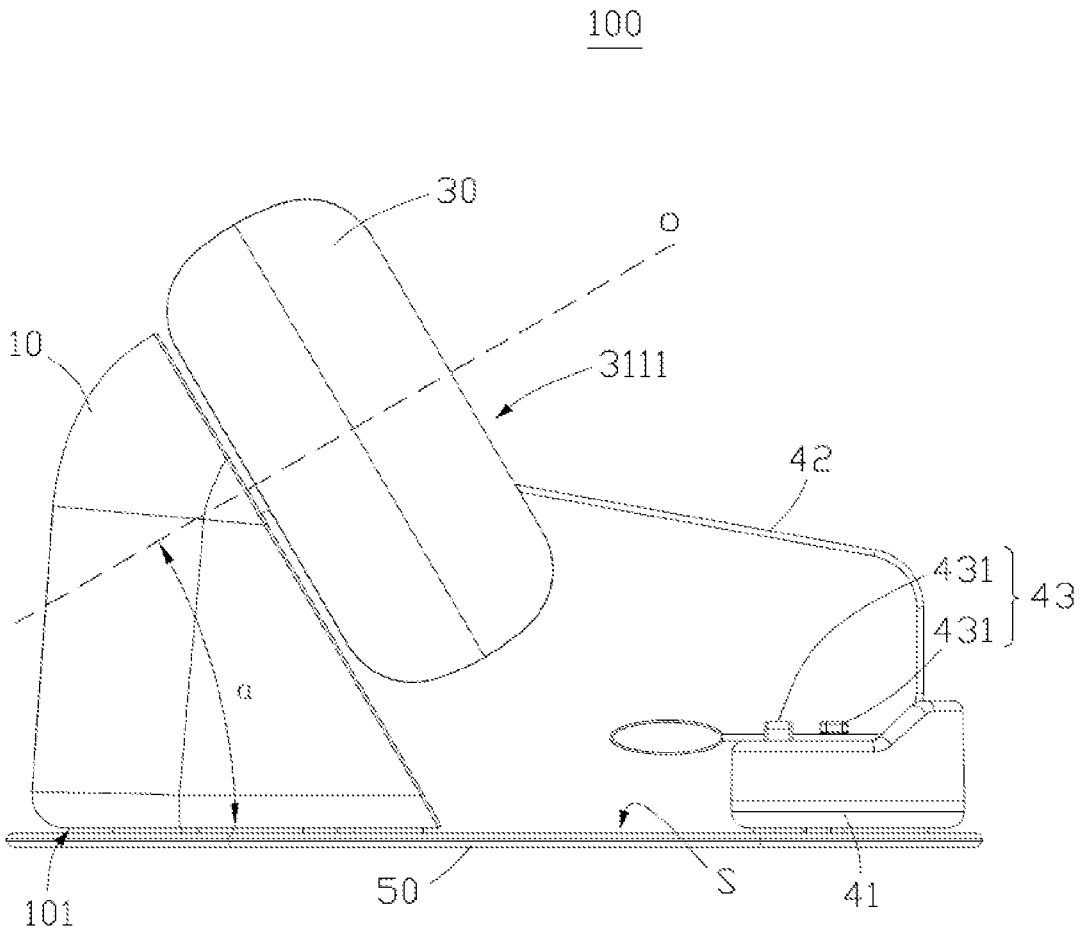
FIG. 2 is a side view of a beading apparatus in FIG. 1.

Referring to FIGS. 1 and 2, an embodiment of this application provides a beading apparatus 100. The beading apparatus 100 is configured to bead-shaped structures 60 into an ornament, and the ornament includes but is not limited to a necklace, a bracelet, and an earring. The shape of bead-shaped structure 60 is not limited and may be spherical, ellipsoidal, flattened, or the like.

The beading apparatus 100 includes a bottom seat 10, a drive member 20, a rotation shell 30, and a needle-like assembly 40. The bottom seat 10 has a placement surface 101, and the placement surface 101 is used for contact with an operation surface S. The drive member 20 is connected to the bottom seat 10. The rotation shell 30 includes an accommodating body 31 and a baffle 32, the accommodating body 31 is connected to the drive member 20, the drive member 20 drives the accommodating body 31 to rotate, a rotation axis of the accommodating body 31 is inclined with respect to the placement surface 101, the accommodating body 31 is provided with an accommodating chamber 3111 for accommodating a bead-shaped structure 60, the accommodating chamber 3111 has an opening 3112, and the baffle 32 is connected in the accommodating chamber 3111. The needle-like assembly 40 is located on a side of the rotation shell 30, and at least part of the needle-like assembly 40 extends into the accommodating chamber 3111 via the opening 3112.

The bead-shaped structure 60 is located in the accommodating chamber 3111, the drive member 20 drives the rotation shell 30 to rotate, and the rotation shell 30 drives the bead-shaped structure 60 to rotate. When it rotates to a specified angle, the bead-shaped structure 60 is thrown out by centrifugal force from the baffle 32 and falls on the needle-like assembly 40. The beading process is simple and quick, and the rotation axis of the rotation shell 30 being inclined with respect to the placement surface 101 can reduce the case of scattering the bead-shaped structure 60 from the rotation shell 30. The baffle 32 allows the bead-shaped structure 60 to fly a greater distance, which is conducive to increasing the beading success rate, thus improving the beading effect.

When the beading apparatus 100 is used, the bottom seat 10 may be placed on the operation surface S, and the placement surface 101 of the bottom seat 10 is in contact with the operation surface S. The operation surface S should be understood as a plane used for the beading apparatus 100 and includes but is not limited to a desktop, a countertop, or a surface of a component.

Figure 3:
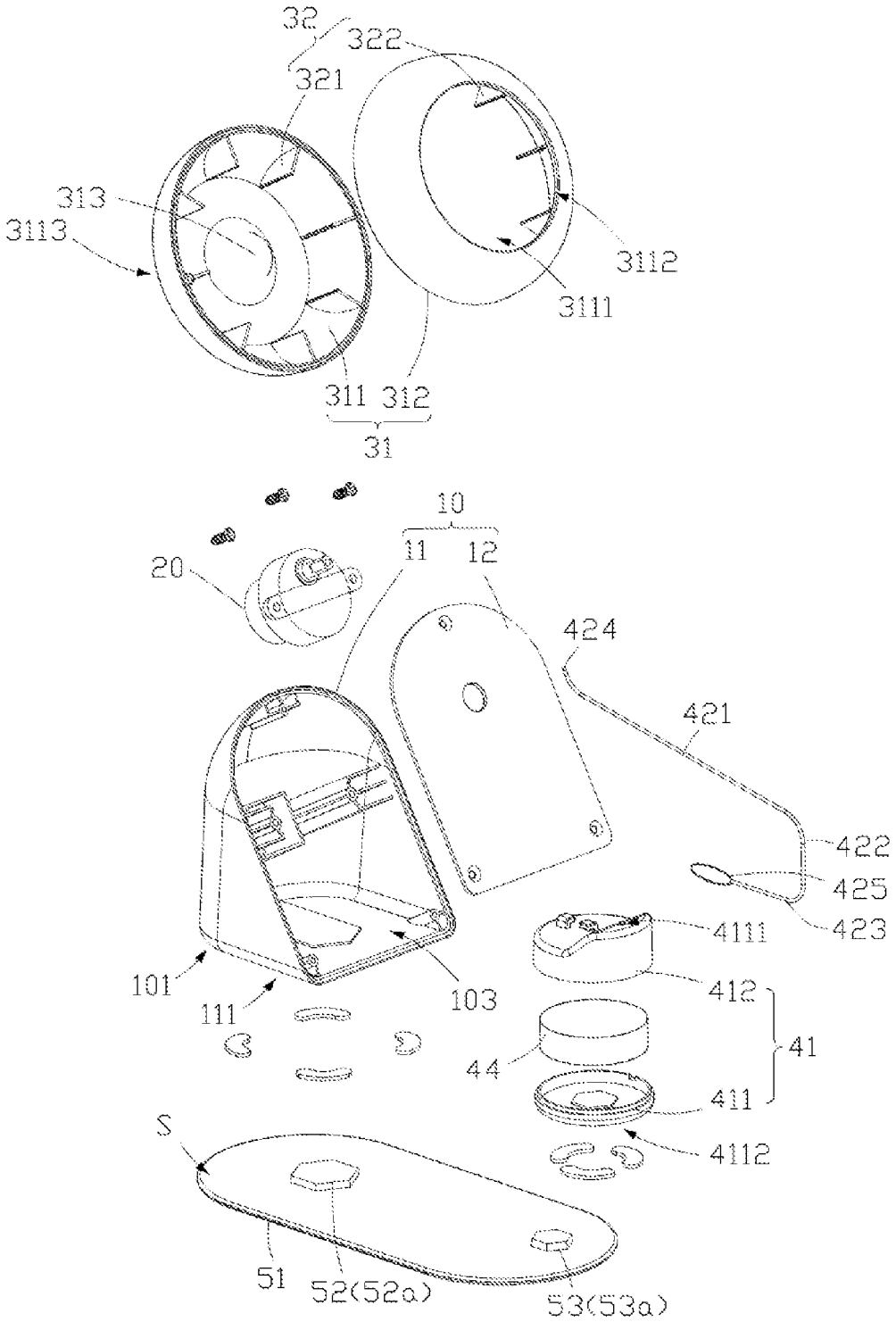
FIG. 3 is an exploded view of the beading apparatus in FIG. 1.

Referring to FIG. 3, the bottom seat 10 is provided with an inner cavity 103 for mounting the drive member 20 therein, thus enabling the bottom seat 10 to be connected to the drive member 20. The bottom seat 10 is disposed in the inner cavity 103 in any manner, which can be selected depending on a specific condition.

In some embodiments, the bottom seat 10 is roughly triangle-shaped, and the bottom seat 10 includes a bottom shell 11 and an upper cover 12. The bottom shell 11 is connected to the upper cover 12, and the bottom shell 11 and the upper cover 12 enclose the inner cavity 103 of the bottom seat 10. The bottom shell 11 is roughly triangle-shaped, and the bottom surface of the bottom shell 11 is the placement surface 101. The shape of the upper cover 12 is roughly a rectangular plate, the drive member 20 is mounted in the bottom shell 11, and the drive shaft of the drive member 20 extends out of the inner cavity 103 via the upper cover 12 to be connected to the rotation shell 30.

Figure 4:
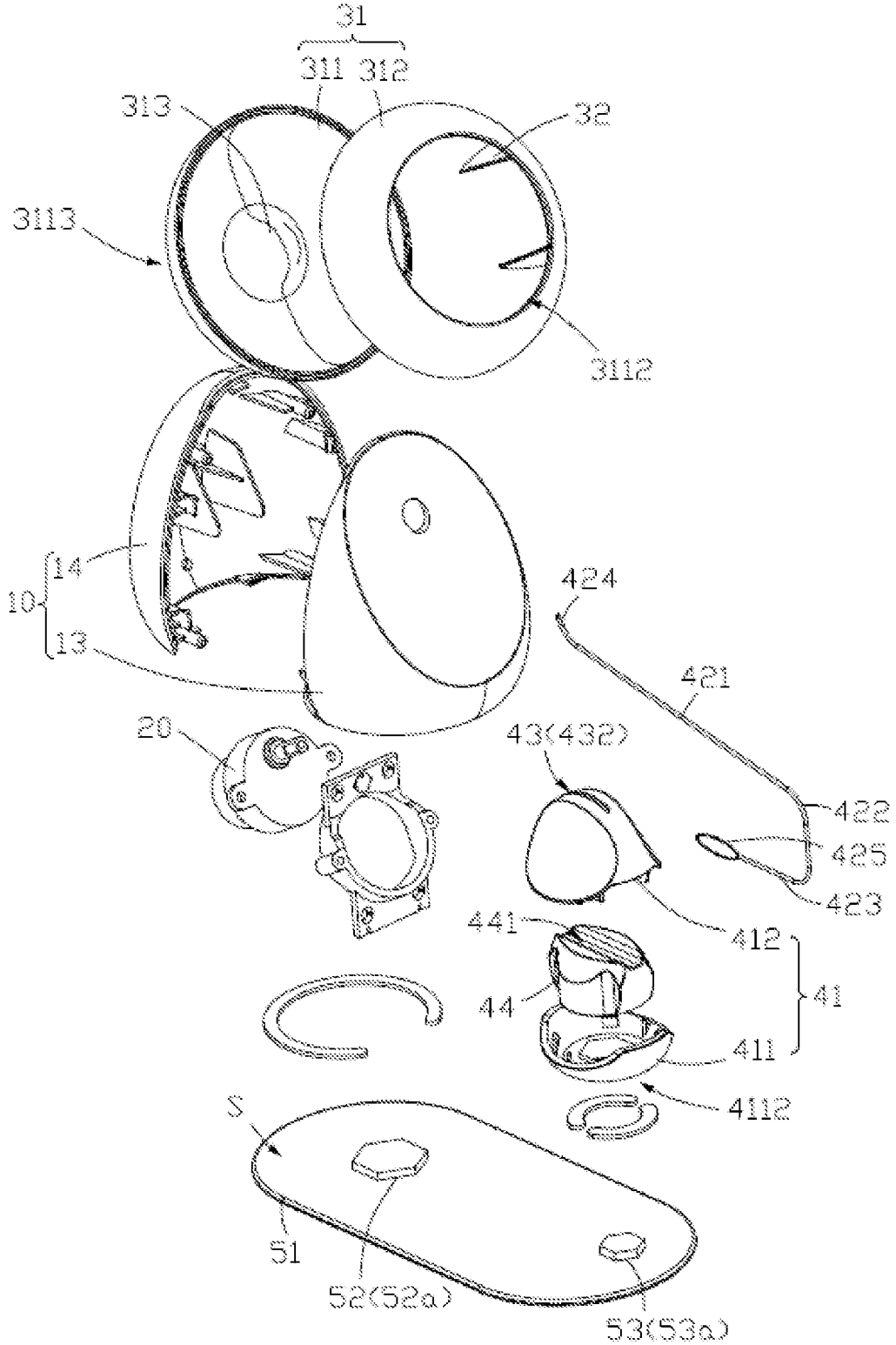
FIG. 4 is an exploded view of a beading apparatus according to another embodiment of this application.

Referring to FIG. 4, in some other embodiments, the bottom seat 10 is roughly elliptic, and the bottom seat 10 includes a front shell 13 and a back shell 14, and the front shell 13 fits with the back shell 14. The bottom surface of the front shell 13 forms the placement surface 101, and the drive member 20 is mounted using a bracket in the inner cavity 103 enclosed by the front shell 13 and the back shell 14. The drive shaft of the drive member 20 extends out of the inner cavity 103 via the front shell 13.

Figure 5:
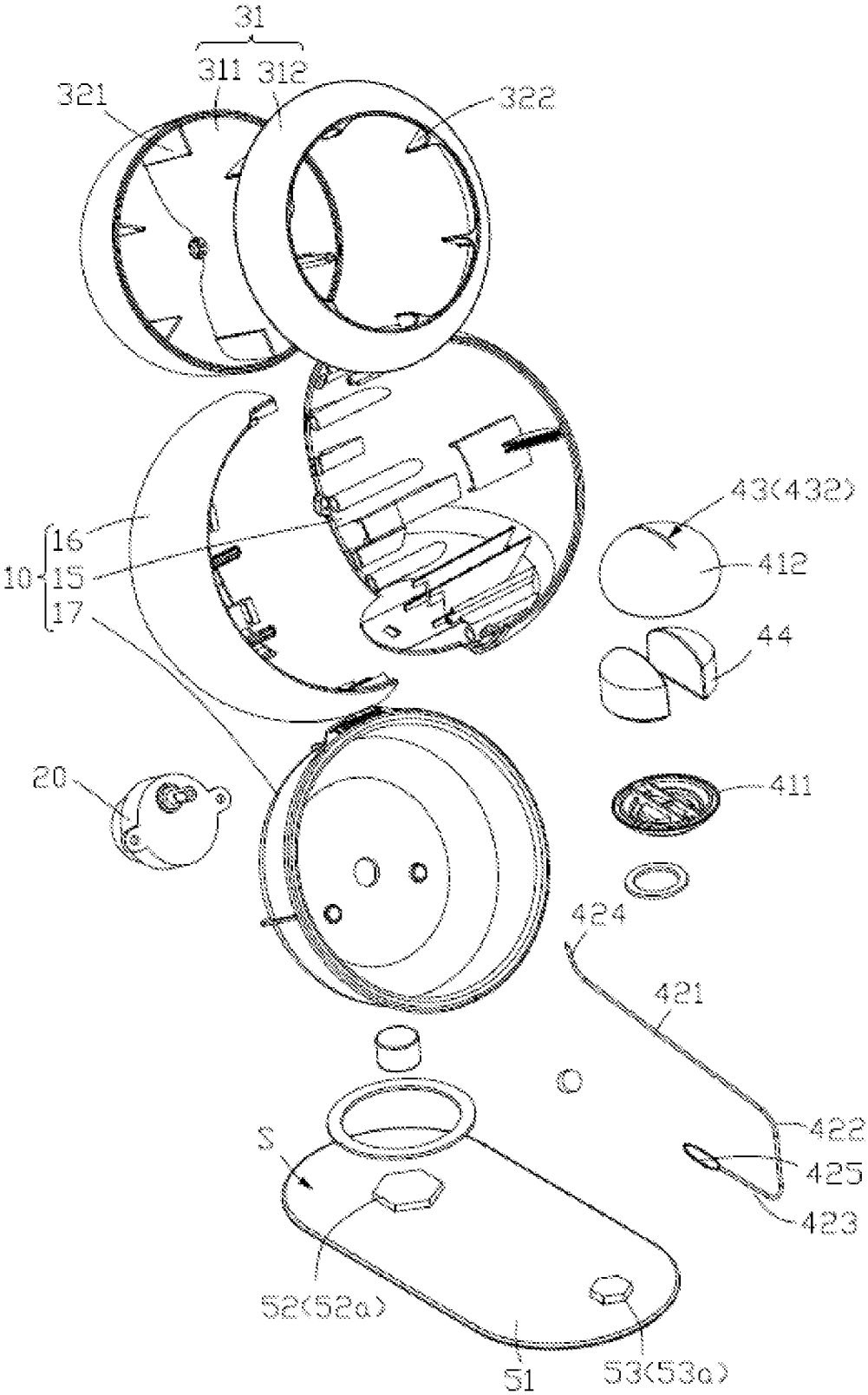
FIG. 5 is an exploded view of a beading apparatus according to another embodiment of this application.

Referring to FIG. 5, in some other embodiments, the bottom seat 10 is roughly circular, and the bottom seat 10 includes a first shell body 15, a second shell body 16, and the third shell body 17. The first shell body 15 and the second shell body 16 are opposite and fit with each other for connection. The bottom surface of the first shell body 15 forms the placement surface 101, and the third shell body 17 is disposed between the first shell body 15 and the second shell body 16. The output shaft of the drive member 20 extends out of the inner cavity 103 through the third shell body 17.

The drive member 20 is located in the inner cavity 103 and the output shaft of the drive member 20 extends out of the inner cavity 103 to be connected to the accommodating body 31, so as to drive the rotation shell 30 to rotate. Optionally, the drive member 20 is a speed reducing motor. It should be noted that the drive member 20 is not limited to the component that drives, using an electric energy, the rotation shell 30 to rotate, such as a motor. In some other embodiments, the drive member 20 may alternatively be a structure such as a rocker bar, and the drive member 20 is rocked manually to drive the rotation shell 30 to rotate.

A side of the accommodating body 31 close to the bottom seat 10 is provided with a connection hole 3113, and the drive shaft of the drive member 20 penetrates through the connection hole 3113 to be connected to the accommodating body 31.

Referring to FIG. 2, the rotation axis of the rotation shell 30 overlaps the axis of the accommodating body 31, and the rotation axis of the rotation shell 30 and the placement surface 101 form a first included angle $\alpha$ of 15°-45°. In this range, the case of scattering the bead-shaped structure 60 from the opening 3112 can be reduced, and the baffle 32 can stably drive the bead-shaped structure 60 to move. Optionally, the first included angle $\alpha$ is 30°.

Referring to FIGS. 3, 4, and 5, in some embodiments, the accommodating body 31 includes a first portion 311 and a second portion 312. The first portion 311 is detachably connected to the second portion 312 along the extension direction of the rotation axis. The first portion 311 and the second portion 312 form an accommodating chamber 3111. The connection hole 3113 is located on a side of the first portion 311 away from the second portion 312, such that the side of the first portion 311 away from the second portion 312 is connected to the drive member 20. The opening 3112 is located on a side of the second portion 312 away from the first portion 311.

The first portion 311 and the second portion 312 are roughly the same in shape of a bowl, thus allowing for a large volume of the accommodating chamber 3111, to increase the quantity of the bead-shaped structures 60. In addition, the inner side wall of the second portion 312 adjacent to the opening 3112 can prevent the bead-shaped structures 60 from being scattered from the opening 3112.

The accommodating body 31, as a separate structure, is separated into the first portion 311 and the second portion 312, which is conducive to producing and assembling the accommodating body 31.

In some embodiments, a wall of the accommodating chamber 3111 away from the opening 3112, that is, a wall of the inner cavity 103 of the first portion 311, is provided with a guiding protrusion 313. Part of the needle-like assembly 40 extending into the accommodating chamber 3111 is located between the guiding protrusion 313 and the baffle 32.

During rotation of the baffle 32, the bead-shaped structures 60 on the baffle 32 are subjected to centrifugal force and thrown at the guiding protrusion 313. Some of the bead-shaped structures 60, under the elastic force of the guiding protrusion 313, sleeve the needle-like assemblies 40 located at the baffle 32 and the guiding protrusion 313, thus facilitating an increase of the beading possibility.

Optionally, a height at which some of the needle-like assemblies 40 are located in the accommodating chamber 3111 is roughly the same as that of the guiding protrusion 313, and these needle-like assemblies 40 are adjacent to the baffle 32 rotating upwards.

Referring to FIGS. 3 and 4, in some embodiments, the guiding protrusion 313 is roughly in the shape of a circular truncated cone, and a surface close to the opening 3112 is a curved surface. The axis of the guiding protrusion 313 overlaps the rotation axis of the rotation shell 30, meaning that the guiding protrusion 313 is located at the center of the accommodating body 31, such that the center of gravity of the entire rotation shell 30 is located on the rotation axis, which is conducive to improving the rotation stability of the rotation shell 30. It can be understood that the shape of the guiding protrusion 313 is not limited to a circular truncated cone and in some other embodiments, may be a cylinder, a cone, or the like.

The fitting between the baffle 32 and the guiding protrusion 313 can improve the beading precision of the beading apparatus 100. The connection manner between the baffle 32 and the accommodating body 31 is not limited. In some embodiments, the baffle 32 has one part integrated with the first portion 311 and the other part extending into the second portion 312. In some other embodiments, the baffle 32 has one part integrated with the second portion 312 and the other part extending into the first portion 311.

Still referring to FIGS. 3 and 4, in some other embodiments, the baffle 32 includes a first blocking piece 321 and a second blocking piece 322. The first blocking piece 321 is connected to the first portion 311, the second blocking piece 322 is connected to the second portion 312, and the first blocking piece 321 is in one-to-one correspondence to the second blocking piece 322 in position. The first blocking piece is connected to the first portion 311, and the second blocking piece is connected to the second portion 312. A large sum of connection areas of the baffle 32 to the first portion 311 and the second portion 312 is conducive to improving the connection stability of the baffle 32. Optionally, the first blocking piece 321 and the second blocking piece 322 are the same in shape and size.

The baffle 32 is provided in plurality. The plurality of baffles 32 are spaced apart around the rotation axis of the rotation shell 30, enabling the baffles 32 can uniformly lift the bead-shaped structures 60, such that the bead-shaped structures 60 are threaded onto the needle-like assemblies 40. Optionally, the baffle 32 is rectangular, and every two adjacent baffles 32 are spaced apart by a same distance.

In some embodiments, the baffle 32 is parallel to the rotation axis of the rotation shell 30, and because the rotation axis is inclined with respect to the placement surface 101, the baffle 32 is also inclined with respect to the placement surface 101. During rotation of the baffle 32, it carries the bead-shaped structure 60. And under the action of gravity, the bead-shaped structure 60 can move in a direction leaving the opening 3112, thus reducing the case of scattering the bead-shaped structure 60 outside the accommodating chamber 3111 from the opening 3112.

Further, the provision of the baffle 32 can increase the flying distance of the bead-shaped structure 60. Even though the bead-shaped structure 60 is in the flattened shape with a large weight and a plane, a good beading success rate can be also achieved.

As the drive member 20 drives the rotation shell 30 to rotate, under the action of the baffles 32, the bead-shaped structures 60 are subjected to centrifugal force and fly out of the baffles 32 to fall onto some of the needle-like assemblies 40 in the accommodating chamber 3111.

Referring to FIGS. 2 and 3, the needle-like assembly 40 includes a base 41 and a beading needle 42, the base 41 is located on a side of the bottom seat 10, and the beading needle 42 has one end connected to the base 41 and the other end extending into the accommodating chamber 3111.

After the baffle 32 throws the bead-shaped structure 60, the bead-shaped structure 60 falls onto the beading needle 42, and under the guide of the beading needle 42, moves towards the base 41. Through the connection between the base 41 and the beading needle 42, the position of the beading needle 42 can be maintained stably without the need to hold the beading needle 42 manually. This facilitates beading and reduction of the scene of manually holding the beading needle 42. Hand shake or false touch causes a large vibration range of the beading needle 42, impacting the beading.

In some embodiments, an upper end of the base 41 is provided with a snap-fitting structure 43, and the snap-fitting structure 43 is snap-fitted with the beading needle 42. The base 41 is connected to the beading needle 42 via the snap-fitting structure 43, which is conducive to mounting or taking out the beading needle 42 and replacing a different beading needle 42.

In some embodiments, the snap-fitting structure 43 includes two clamping blocks 431, and the two clamping blocks 431 are apart from each other in a length direction of the beading needle 42 and snap-fitted with the beading needle 42, thus limiting the position of the beading needle 42.

Optionally, the two clamping blocks 431 are the same in shape, and each include a vertical portion and a horizontal portion. The vertical portion is connected to the upper surface of the base 41 and the horizontal portion is connected to the vertical portion. In a horizontal direction perpendicular to the length direction of the beading needle 42, the vertical portions of the two clamping blocks 431 are spaced apart by a distance, such that the two vertical portions can be in contact with two opposite sides of the beading needle 42, and the vertical portions fit with the surface of the base 41, thus limiting the position of the beading needle 42.

Referring to FIG. 3, in some embodiments, the base 41 is further provided with a limiting groove 4111, and part of the beading needle 42 is located in the limiting groove 4111, thus positioning the beading needle 42, so as to further improve the stability of the beading needle 42.

Referring to FIGS. 4 and 5, it can be understood that the snap-fitting structure 43 is not limited to the clamping block 431. In some other embodiments, the snap-fitting structure 43 is a slot 432, the slot 432 is located on the base 41, and the slot 432 is snap-fitted with the beading needle 42.

The beading needle 42 is directly inserted into the slot 432, thus limiting the position of the beading needle 42. The beading needle 42 is directly pulled out of the slot 432, thus disassembling the beading needle 42. It is simple and quick to mount or disassemble the beading needle 42.

Referring to FIG. 3, the shape of the base 41 is not limited and can be selected specifically based on the type of the snap-fitting structure 43. For example, when the snap-fitting structure 43 is a clamping block 431, the shape of the base 41 is roughly a cylinder. Part of the upper surface of the base 41 is a plane and used for the provision of the two clamping blocks 431. The other part of the upper surface of the base 41 is an inclined surface, and the limiting groove 4111 is provided on the inclined surface.

Referring to FIG. 4, for another example, when the snap-fitting structure 43 is a slot 432, the shape of the base 41 is roughly a cylinder with a spherical upper surface. Referring to FIG. 5, further, on the spherical basis, two opposite sides of the base 41 are provided with grooves for gripping.

Referring to FIGS. 3, 4, and 5, the base 41 includes a lower shell 411 and an upper shell 412 that fit with each other, and the snap-fitting structure 43 is disposed on the upper shell 412. In some embodiments, the needle-like assembly 40 further includes a counterweight block 44, and the counterweight block 44 is disposed in a cavity formed by the lower shell 411 and the upper shell 412.

The provision of the counterweight block 44 increases the weight of the base 41, which can improve the stability of the beading needle 42 and reduce the case of tumbling the needle-like assembly 40 during beading.

Referring to FIG. 4, when the snap-fitting structure 43 is the slot 432, the counterweight block 44 is further provided with a snap-fitting position 441. The snap-fitting position 441 is in communication with the slot 432, and at least part of the beading needle 42 is located at the snap-fitting position 441, so as to improve the stability of the beading needle 42.

Referring to FIGS. 2 and 3, the provision of the snap-fitting structure 43 and the counterweight block 44 can improve the stability of the beading needle 42, which facilitates beading using the beading needle 42. The beading needle 42 includes a needle tip 424, a needle body, and a needle eye 425 that are connected sequentially, the needle tip 424 is located in the accommodating chamber 3111 and faces a direction close to the needle body, the needle tip 424 is inclined towards a plane on which the placement surface 101 is located, the needle body has one end connected to the needle tip 424 and the other end connected to the needle eye 425, and the needle body is connected to the base 41.

Under action of centrifugal force, the bead-shaped structure 60 separated from the baffle 32 can fall onto the needle tip 424, move to the needle body from the needle tip 424, and move towards the needle eye 425 under the guide of the needle body. A string for beading can be connected to the needle eye 425, enabling the bead-shaped structure 60 to be on the string after passing through the needle eye 425. The needle tip 424 is inclined with respect to a plane on which the placement surface 101 is located, which is conducive for the needle tip 424 to pass through the through hole of the bead-shaped structure 60. The material of the beading needle 42 is metal, which may be pure metal such as iron, copper, or aluminum, or alloy, such as stainless steel, spring steel, or alloy copper. The metal material has good hardness and can improve the stability of the beading needle 42, narrow the vibration range of the beading needle 42 during operation of the beading apparatus 100, and reduce the case that an excessively large vibration range of the beading needle 42 makes it difficult for the needle tip 424 to enter the bead-shaped structure 60, thus improving the beading efficiency.

In some embodiments, the needle body includes a first segment 421, a second segment 422, and a third segment 423 that are connected sequentially, the first segment 421 is connected to an end of the needle tip 424 and partially located in the accommodating chamber 3111, and faces a direction close to the second segment 422, the first segment 421 is inclined towards the plane on which the placement surface 101 is located, the second segment 422 is perpendicular to the plane on which the placement surface 101 is located, the third segment 423 is connected to the needle eye 425 and parallel to the plane on which the placement surface 101 is located, and the third segment 423 is connected to the base 41 via the snap-fitting structure 43.

The first segment 421 is inclined, which is conducive to guiding the bead-shaped structure 60 to move. The second segment 422 is perpendicular to a plane on which the placement surface 101 is located, that is, placed vertically, such that the third segment 423 can be connected to the base 41 via the snap-fitting structure 43.

One end of the third segment 423 is connected to the second segment 422 and extends in a direction close to the bottom seat 10, such that a distance between the needle eye 425 and the bottom seat 10 is smaller than a distance between the second segment 422 and the bottom seat 10. This can shorten the force arm of the beading needle 42 for the base 41, and is conducive to improving the stability of the base 41.

An included angle between the first segment 421 and the plane on which the placement surface 101 is located is smaller than the first included angle $\alpha$, that is, an included angle between the rotation axis and the plane on which the placement surface 101 is located. This allows for a proper height of the needle tip 424 and can reduce the case of affecting the beading success rate by the excessively large height of the needle tip 424. Optionally, the included angle between the first segment 421 and the plane on which the placement surface 101 is 10.3°. Optionally, the first segment 421, the second segment 422, and the third segment 433 have the same string diameter of 0.6 mm-1.2 mm. The proper string diameter of the needle body allows for enough strength and stability of the needle body, and also conforms to the diameter of the through hole of the bead-shaped structure 60, allowing the bead-shaped structure 60 to slide on the needle body after successful beading.

In some embodiments, the beading apparatus 100 further includes a positioning assembly 50, and the positioning assembly 50 is configured to position the bottom seat 10 and the base 41, thus improving the location precision of the needle tip 424 in the accommodating chamber 3111 and the angle of the needle tip 424 with respect to the placement surface 101, facilitating the improvement in the success rate of beading.

Referring to FIGS. 3, 4, and 5, the positioning assembly 50 includes a positioning plate 51, a first positioning portion 52, and a second positioning portion 53. The first positioning portion 52 and the second positioning portion 53 are spaced apart on the positioning plate 51, their spacing direction being consistent with the length direction of the beading needle 42. The bottom seat 10 is disposed on the positioning plate 51 and fits with the first positioning portion 52 for positioning. The base 41 of the needle-like assembly 40 is disposed on the positioning plate 51 and fits with the second positioning portion 53.

When the beading apparatus 100 includes the positioning assembly 50, the positioning plate 51 is provided with a first positioning portion 52 and the surface of the second positioning portion 53 is an operation surface S. The fitting between the first positioning portion 52 and the bottom seat 10 contributes to fitting between the second positioning portion 53 and the base 41. This therefore limits the distance between the bottom seat 10 and the base 41, thus limiting the position of the needle tip 424 in the accommodating chamber 3111.

Optionally, the first positioning portion 52 is a first positioning protrusion 52*a*, the bottom of the bottom seat 10 is provided with a first positioning groove 111, and the first positioning protrusion 52*a* is located in the first positioning groove 111. The second positioning portion 53 is a second protrusion, the bottom of the base 41 of the needle-like assembly 40 is provided with a second positioning groove 4112, and the second protrusion is located in the second positioning groove 4112.

The bottom seat 10 is directly placed on the first positioning protrusion 52*a*, and the base 41 is directly placed on the second positioning protrusion 53*a* to complete positioning. The positioning manner is simple and quick. It can be understood that the first positioning portion 52 and the second positioning portion 53 are not limited to the protrusions. In some other embodiments, the first positioning portion 52 and the second positioning portion 53 may be alternatively grooves, and bottoms of the bottom seat 10 and the base 41 are correspondingly provided with protrusions.

Optionally, the first positioning protrusion 52*a*, a wall of the first positioning groove 111, the second positioning portion 53*a*, and a wall of the second positioning groove 4112 are magnets attracted to each other, or are mounted with magnets at corresponding positions, so as to improve the stability of connection.

In summary, this embodiment of this application provides a beading apparatus 100. The rotation axis is inclined with respect to the placement surface 101 and the arrangement of the baffle 32 improves the flying distance of the bead-shaped structure 60, which is conducive to improving the beading success rate and reducing the case of scattering the bead-shaped structure 60 from the opening 3112, facilitating the improvement of the beading effect.

Figure 6:
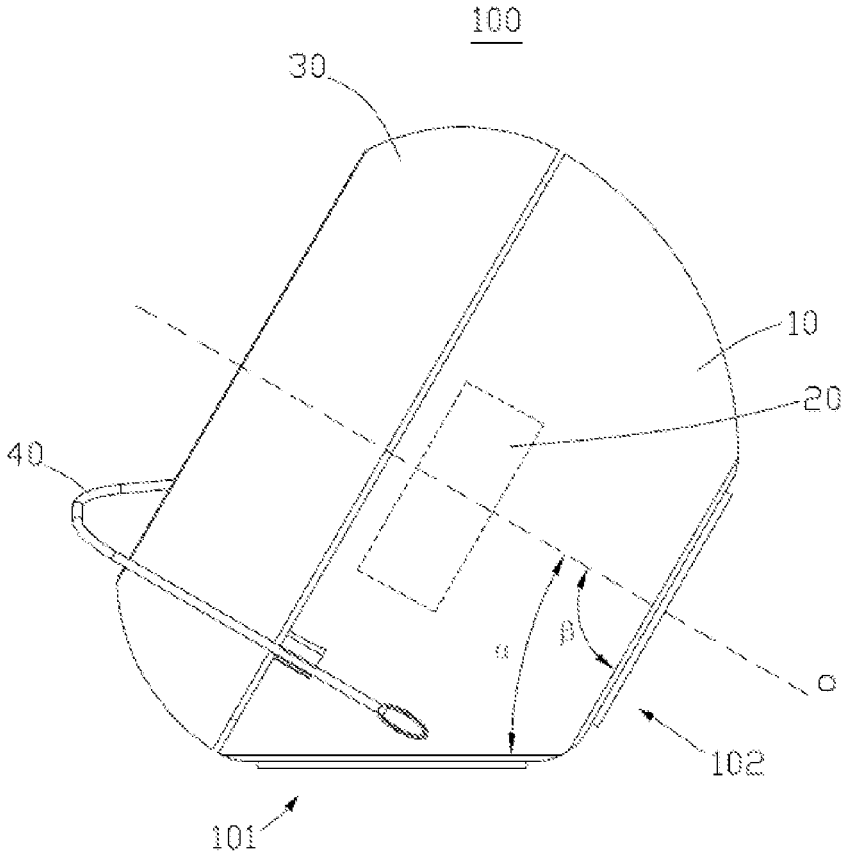
FIG. 6 is a side view of a beading apparatus according to another embodiment of this application.
Figure 7:
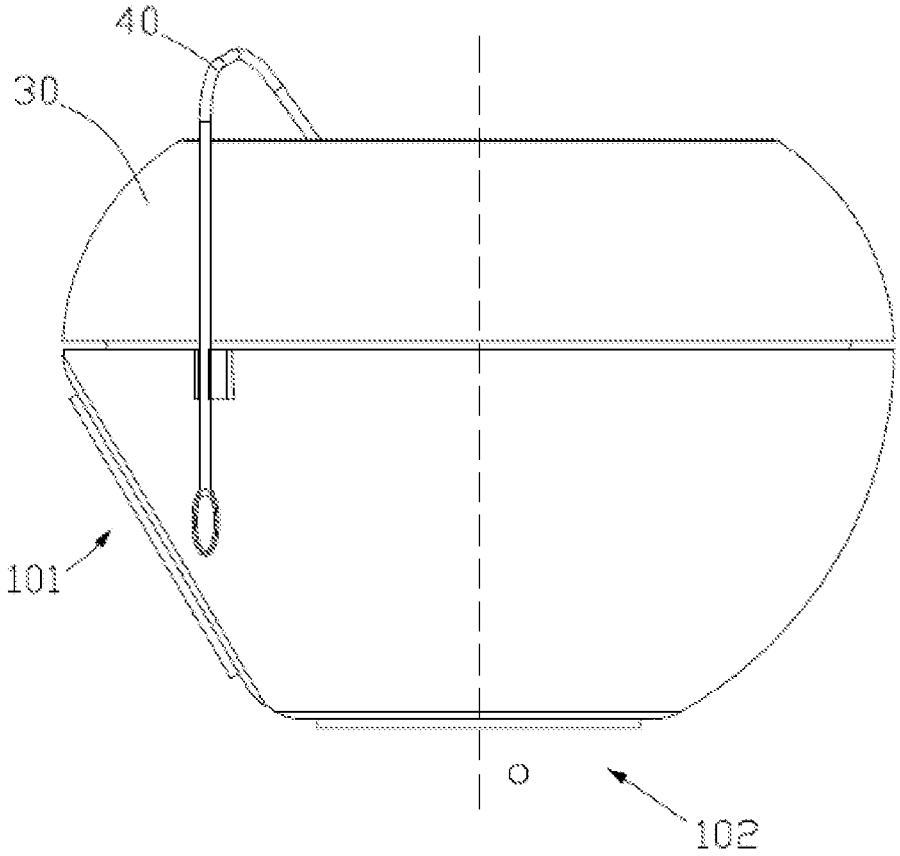
FIG. 7 is a side view of the beading apparatus in another mode in FIG. 6.

Referring to FIGS. 6 and 7, an embodiment of this application provides another beading apparatus 100, which is different from the beading apparatus 100 in the foregoing embodiment in that the bottom seat 10 is provided with a mounting surface 102. The user can select the mounting surface 102 or the placement surface 101 to be in contact with the operation surface S based on specific requirements.

Specifically, the beading apparatus 100 includes a bottom seat 10, a drive member 20, a rotation shell 30, and a needle-like assembly 40. The bottom seat 10 has a placement surface 101 and a mounting surface 102 for contact with an operation surface S, and the placement surface 101 and the mounting surface 102 intersect. The drive member 20 is connected to the bottom seat 10. The rotation shell 30 is connected to the drive member 20, the drive member 20 drives the rotation shell 30 to rotate, a rotation axis of the rotation shell 30 and the placement surface 101 form a first included angle $\alpha$, a rotation axis of the rotation shell 30 and the mounting surface 102 form a second included angle $\beta$, the first included angle $\alpha$ is different from the second included angle $\beta$, the rotation shell 30 is provided with an accommodating chamber 3111 for accommodating a bead-shaped structure 60, and the accommodating chamber 3111 has an opening 3112. The needle-like assembly 40 is located on a side of the rotation shell 30, and at least part of the needle-like assembly 40 extends into the accommodating chamber 3111 via the opening 3112.

The first included angle $\alpha$ is different from the second included angle $\beta$, and thus when the placement surface 101 or the mounting surface 102 is placed on the operation surface S, the rotation axis and the operation surface S form a different included angle. Thereby, based on the type of the bead-shaped structure 60 in the accommodating chamber 3111, a different surface can be selected to be in contact with the operation surface S, thus improving the placement effect.

Optionally, the mounting surface 102 is adjacent to the operation surface S, and the bottom seat 10 is flipped over to switch a different plane to be in contact with the operation surface S. The switch process is simple and quick.

In some embodiments, the first included angle $\alpha$ is in a range of 15°-45°, the second included angle $\beta$ is 90°, and the mounting surface 102 is directly opposite the opening 3112. When the bead-shaped structure 60 is in a flattened shape, the placement surface 101 may be in contact with the operation surface S. When the bead-shaped structure 60 is in a circular shape, the mounting surface 102 may be selected to be in contact with the operation surface S.

The needle-like assembly 40 is a needle body, the needle body has one end snap-fitted with the side wall of the bottom seat 10, and the needle body is bended to be partially located in the accommodating chamber 3111.

In summary, in the beading apparatus 100 of this application, as the bottom seat 10 is provided with the placement surface 101 and the mounting surface 102, a different surface can be selected to be in contact with the operation surface S, thus adjusting the inclined angle between the rotation axis and the operation surface S. And it is simple and quick to adjust the included angle between the rotation angle and the operation surface S. Based on a different type of the bead-shaped structure 60, a different plane is selected to be in contact with the operation surface S, which can improve the beading success rate and enjoyment.

The above descriptions are only specific implementations of this application, but the protection scope of this application is not limited thereto. Any person skilled in the art can easily think of various equivalents within the technical scope disclosed by this application. Modifications or substitutions should be included within the protection scope of this application. Therefore, the protection scope of the this application should be subject to the protection scope of the claims.

What is claimed is:

1. A beading apparatus, comprising:

a bottom seat, wherein the bottom seat has a placement surface for contact with an operation surface;

a drive member, wherein the drive member is connected to the bottom seat;

a rotation shell, wherein the rotation shell comprises an accommodating body and a baffle, the accommodating body is connected to the drive member, a rotation axis of the accommodating body is inclined with respect to the placement surface, the accommodating body is provided with an accommodating chamber for accommodating a bead-shaped structure, the accommodating chamber has an opening, and the baffle is connected in the accommodating chamber, the accommodating body comprises a first portion and a second portion, the drive member drives the first portion and the second portion to rotate, the baffle comprises a first blocking piece and a second blocking piece, the first blocking piece is connected to the first portion, the second blocking piece is connected to the second portion, and the first blocking piece is in one-to-one correspondence to the second blocking piece in position; and a needle-like assembly, wherein the needle-like assembly is located on a side of the rotation shell, and at least part of the needle-like assembly extends into the accommodating chamber via the opening.

2. The beading apparatus according to claim 1, wherein one side of the first portion is connected to the drive member, the other side of the first portion fits with the second portion to form the accommodating chamber, and a side of the second portion away from the first portion is provided with the opening.

3. The beading apparatus according to claim 1, wherein such baffle is provided in plurality, and the plurality of baffles are spaced apart from each other around a rotation axis of the rotation shell.

4. The beading apparatus according to claim 1, wherein the baffle is parallel to the rotation axis of the rotation shell.

5. The beading apparatus according to claim 1, wherein the rotation axis of the rotation shell and the placement surface form a first included angle of 15°-45°.

6. The beading apparatus according to claim 1, wherein a side wall of the accommodating chamber away from the opening is provided with a guiding protrusion, and the part of the needle-like assembly extending into the accommodating chamber is located between the guiding protrusion and the baffle.

7. The beading apparatus according to claim 6, wherein an axis of the guiding protrusion overlaps the rotation axis of the rotation shell.

8. The beading apparatus according to claim 1, wherein the beading apparatus further comprises a positioning assembly, the positioning assembly comprises a positioning plate, a first positioning portion, and a second positioning portion, the first positioning portion and the second positioning portion are apart from each other on the positioning plate, the bottom seat is disposed at the positioning plate and fits with the first positioning portion for positioning, and the needle-like assembly is disposed at the positioning plate and fits with the second positioning portion for positioning.

9. The beading apparatus according to claim 8, wherein the first positioning portion is a first positioning protrusion, the bottom seat is provided with a first positioning groove, the first positioning protrusion is located in the first positioning groove, the second positioning portion is a second protrusion, the needle-like assembly is provided with a second positioning groove, and the second protrusion is located in the second positioning groove.

10. The beading apparatus according to claim 1, wherein the needle-like assembly comprises a base and a beading needle, the base is located on a side of the bottom seat, and the beading needle has one end connected to the base and the other end extending into the accommodating chamber.

11. The beading apparatus according to claim 10, wherein the beading needle comprises a needle tip, a needle body, and a needle eye that are connected sequentially, the needle tip is located in the accommodating chamber and faces a direction close to the needle body, the needle tip is inclined towards a plane on which the placement surface is located, the needle body has one end connected to the needle tip and the other end connected to the needle eye, and the needle body is connected to the base.

12. The beading apparatus according to claim 11, wherein the needle body comprises a first segment, a second segment, and a third segment that are connected sequentially, the first segment is connected to an end of the needle tip and partially located in the accommodating chamber, and faces a direction close to the second segment, the first segment is inclined towards the plane on which the placement surface is located, the second segment is perpendicular to the plane on which the placement surface is located, the third segment is connected to the needle eye and parallel to the plane on which the placement surface is located, and the third segment is connected to the base.

13. The beading apparatus according to claim 12, wherein an included angle between the first segment and the plane on which the placement surface is located is smaller than an included angle between the rotation axis and the plane on which the placement surface is located.

14. The beading apparatus according to claim 10, wherein the base is provided with a snap-fitting structure, and the snap-fitting structure is snap-fitted with the beading needle.

15. The beading apparatus according to claim 14, wherein the snap-fitting structure comprises two clamping blocks, and the two clamping blocks are apart from each other in a length direction of the beading needle and snap-fitted with the beading needle.

16. The beading apparatus according to claim 14, wherein the snap-fitting structure is a slot, and the slot is snap-fitted with the beading needle.

17. The beading apparatus according to claim 16, wherein the needle-like assembly further comprises a counterweight block, the counterweight block is provided with a snap-fitting position for communication with the slot, and the beading needle is at least partially located at the snap-fitting position.

18. A beading apparatus, comprising:

a bottom seat, wherein the bottom seat has a placement surface and a mounting surface for contact with an operation surface, and the placement surface and the mounting surface intersect;

a drive member, wherein the drive member is connected to the bottom seat;

a rotation shell, wherein the rotation shell is connected to the drive member, the drive member drives the rotation shell to rotate, a rotation axis of the rotation shell and the placement surface form a first included angle, the rotation axis of the rotation shell and the mounting surface form a second included angle, the first included angle is different from the second included angle, the rotation shell is provided with an accommodating chamber for accommodating a bead-shaped structure, and the accommodating chamber has an opening; and a needle-like assembly, wherein the needle-like assembly is connected to the rotation shell, and at least part of the needle-like assembly extends into the accommodating chamber via the opening, and the first included angle is 15°-45°, and the second included angle is 90°.

* * * * *